United States Patent [19]

Newton

[11] 4,065,375

[45] Dec. 27, 1977

[54] APPARATUS FOR PROVIDING FLOW OF ELECTROLYTE THROUGH ELECTROLYTIC CELLS

[75] Inventor: Alan Frank Roy Newton, Portsmouth, England

[73] Assignee: Parel Societe Anonyme, Luxembourg, Luxembourg

[21] Appl. No.: 631,676

[22] Filed: Nov. 13, 1975

[30] Foreign Application Priority Data

Nov. 13, 1974 United Kingdom ..... 49184/74

[51] Int. Cl.[2] ..... C25B 15/08; C25D 21/10; C25D 17/00

[52] U.S. Cl. ..... 204/237; 204/263; 204/273; 204/275

[58] Field of Search ..... 204/275, 263, 284, 237

[56] References Cited

U.S. PATENT DOCUMENTS

| | | | |
|---|---|---|---|
| 3,457,152 | 7/1969 | Maloney et al. | 204/275 X |
| 3,945,892 | 3/1976 | James et al. | 204/263 X |
| 3,951,773 | 4/1976 | Claessens et al. | 204/275 X |
| 3,981,787 | 9/1976 | James et al. | 204/263 X |

FOREIGN PATENT DOCUMENTS

| | | | |
|---|---|---|---|
| 1,194,181 | 6/1970 | United Kingdom | 204/284 X |

*Primary Examiner*—Howard S. Williams
*Assistant Examiner*—D. R. Valentine
*Attorney, Agent, or Firm*—Armstrong, Nikaido & Marmelstein

[57] ABSTRACT

An electrode system is disclosed which comprises a vessel having an ion-permeable wall; a current feeder within said vessel spaced apart from said ion-permeable wall; and a plurality of electrically conductive particles free to move within a region between the current feeder and the ion-permeable wall and constituting, in use, a particulate electrode. The vessel incorporates at the base thereof a flow distributor such that, when the electrode system is in use, a fluid discharged into the vessel through the flow distributor debouches into the vessel in a direction away from the ion-permeable wall towards one or more surfaces in, or forming part of, the vessel and is deflected by said one or more surfaces towards the ion-permeable wall. An electrochemical cell and electrochemical process using such an electrode system are also disclosed.

26 Claims, 5 Drawing Figures

APPARATUS FOR PROVIDING FLOW OF ELECTROLYTE THROUGH ELECTROLYTIC CELLS

Figure 1:
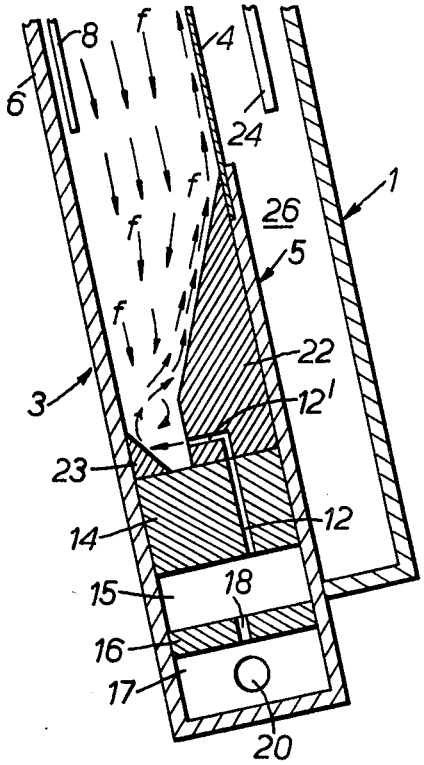

This invention relates to electrochemical cells and more particularly is concerned with electrochemical cells employing one or more particulate electrodes.

In our copending British patent application No. 34077/74 there is disclosed an electrochemical process and an electrode system which with a counter electrode forms an electrochemical cell, suitable to perform said electrochemical process. The electrode system comprises a particulate electrode, a current feeder, a vessel which contains said particulate electrode and current feeder and has an ion-permeable wall at least a part of which is inclined towards the particulate electrode to overlie the same, and means for flowing a fluid medium through said vessel in contact with said particulate electrode. The process disclosed comprises controlling the distribution of the particles of the particulate electrode in the electrolyte in a manner such that there is formed within said vessel a first region which is adjacent to the ion-permeable wall and within which first region substantially all the particles are, for a large proportion of the time they spend in said first region, separated from each other, and a second region which is spaced from the ion-permeable wall and within which second region substantially all the particles are, for a large proportion of the time they spend in said second region, in contact with other particles, and circulating substantially all the particles between said first and second regions.

It is believed that, in processes involving the electrodeposition of metals onto the particles of a particulate cathode, the imposing of this distribution onto the particles of the cathode may result in a reduction in the rate of agglomeration of particles, in the rate of electrodeposition onto the current feeder and in the rate of plating on or within the ion-permeable wall over and above those rates generally associated with fluidised bed particulate cathodes.

According to the present invention there is provided an electrode system comprising a vessel having an ion-permeable wall; a current feeder within said vessel spaced apart from said ion-permeable wall; and a plurality of electrically conductive particles free to move within a region between and current feeder and the ion-permeable wall and constituting, in use, a particulate electrode, said vessel incorporating at the base thereof a flow distributor which comprises at least one channel discharging into the interior of the vessel, the channel or channels being so arranged that, when said electrode system is in use, a fluid discharged into said vessel through said flow distributor debouches into said vessel in a direction away from the ion-permeable wall towards one or more surfaces in, or forming part of, the vessel and is deflected by said one or more surfaces towards the ion-permeable wall.

The invention also provides an electrochemical cell including an electrode system as just defined.

The vessel advantageously comprises a back wall, a base portion in which the flow distributor is located and a support wall comprising the ion-permeable wall.

The ion-permeable wall can be planar and parallel to the back wall of the vessel, so that in section perpendicular to the back wall the vessel is generally rectangular. With such an arrangement, the vessel will generally be tilted when in use so that the ion-permeable wall is no longer is a vertical plane. The angle of tilt used may be from about 0° to about 40°, though the angle of tilt employed will typically be from about 15° to about 30° from the vertical. The direction of the tilt is such that the ion-permeable wall overlies, i.e., is inclined in the upward direction towards, the particulate electrode. The channel or channels will then discharge fluid (generally aqueous electrolyte) into the interior of the vessel at an angle to the upward vertical which is to the same side of the vertical as, but is greater than, the angle to the upward vertical at which the ion-permeable wall is inclined. It has been found that with such an arrangement it may be advantageous for portions of the vessel adjacent the outlets of the channel or channels of the flow distributor to be downwardly and inwardly tapered.

The surface onto which fluid is directed when the electrode system is in operation can be the back wall of the vessel. Alternatively, a tapered member may be interposed between the outlet of the channel or channels and the back wall so that the tapered member acts as the deflecting surface. Other arrangements, such as compound surfaces or baffles, may operate satisfactorily but are not preferred because of the complexity which they involve.

When the electrode system is in use, electrolyte is introduced into the vessel (which normally constitutes an electrode compartment of an electrochemical cell) through the channel(s) of the flow distributor. The ion-permeable wall is normally included as part of a separator which acts as a boundary wall for the vessel and which separates the electrode compartment within the vessel from another electrode compartment containing a counter electrode.

There are preferably a plurality of substantially parallel channels debouching into the interior of the vessel. The outlets of the channels are preferably arranged in line, or in two or more parallel lines, with even spacing between individual channel outlets.

The rate of flow of electrolyte through the flow distributor and into the vessel should be maintained so that a distribution of the particles of the particulate electrode is established in the vessel in a manner such that the particles circulate around the vessel. With the vessel positioned so that the ion-permeable wall overlies the particulate electrode, the particles move in paths comprising an upward movement near the ion-permeable wall in the separator and a downward movement near the back wall of the vessel opposite the ion-permeable wall. Furthermore, the number of particles per unit volume in regions near the ion-permeable wall is considerably less than in those regions in which the particles are moving downwardly where the number of particles per unit volume, in general, may approach that of a settled bed of the particles.

The particulate electrode can be formed of metallic spherules, for example copper, nickel or cobalt spherules. The electrode preferably consists of particles in the size range from 100 to 3000 microns, and more preferably from 300 to 2000 microns. The current feeder may be recessed into the back wall of the vessel.

When an electrode system according to the present invention is used in a process as described above, the channels of the flow distributor direct the electrolyte flowing through the channels towards a surface, e.g., the back wall, of the vessel. It is believed that the electrolyte impinges on, for example, the back wall and is deflected therefrom towards the ion-permeable wall. It has been found that this results in an apparently uniformly dispersed mixture of particles and electrolyte rising up the ion-permeable wall.

If the channels are inclined at a small angle to the plane of the ion-permeable wall, then the point at which the rising flow of particles and electrolyte appears first to meet the separator can be a considerable distance above the flow distributor; also, the orifices of the channels nearest to the back wall of the vessel can be relatively close thereto. However, if the channels are inclined at a large angle, or are normal to, the plane of the ion-permeable wall then the rising flow of particles and electrolyte appears first to meet the separator only a small distance above the point of entry of the channels into the vessel; also, the orifices of the channels nearest to the back wall of the vessel should have a greater spacing therefrom than with small angled channels.

It has been found that the preferred angle at which the channel or channels are inclined is governed by the general configuration of the flow distributor and of those portions of the vessel adjacent the outlets of the channel or channels. Thus, embodiments of the electrode system according to the invention can feature a preferred angle which may be inclined at an angle as small as about 7° or as large as about 90° to the upward direction of the plane of the ion-permeable wall depending on the precise configuration of each embodiment. Preferably, the configuration of each embodiment is such as substantially to prevent liquid and particles from flowing onto the ion-permeable wall at large angles of incidence and thus subjecting the ion-permeable wall to mechanical damage caused for example by abrasion or by electrodeposition on and/or within the ion-permeable wall. Conveniently, the flow may be arranged so as to strike inert, ion-impermeable portions of the separator which portions are disposed against part of, and extend generally downwardly from, the ion-permeable wall. The flow then passes generally upwardly through the region of the vessel adjacent the ion-permeable wall in a direction substantially parallel to the plane of the ion-permeable wall.

It has been found that, for a given configuration of flow distributor and vessel, the pressure drop across the flow distributor must be carefully controlled within a predetermined range if stable flow characteristics are to be maintained. The choice of dimensions of the channel(s) and their location within the flow distributor is influenced inter alia by the desirability of (a) achieving the desired pressure drop in the electrolyte across the flow distributor for a chosen flow rate of electrolyte and (b) preventing the influx of particles into the channels in the absence of electrolyte flow therethrough. If the channels are inclined at a large angle to the vertical then, for any given particle size, these channels will be less likely to allow particles to pass through them than will channels disposed at a small angle to the vertical.

It is desirable to achieve equal flow rates through all of the channels in the distributor. To this end, the flow distributor preferably includes an expansion chamber which in use feeds the fluid to the channels. The expansion chamber may be supplied directly with fluid, or may be supplied via (or contain) a predistributor.

An electrode system in accordance with the present invention may be used in an electrochemical process as described and claimed in our copending patent application No. 34077/74 or in an electrochemical apparatus as described and claimed in our copending patent application No. 24077/74. The process can be, for example, for the electrowinning of metals and may be as described and claimed in our copending patent application No. 31524/74. The present invention also provides an electrochemical process in which there is used an electrochemical cell including an electrode system of the invention (as cathode) and a non-particulate anode, the process comprising applying a difference in electrical potential between the cathode and the anode while directing electrolyte through the channel or channels of the flow distributor of said electrode system in a direction away from the ion-permeable wall towards the one or more surfaces in, or forming part of, the vessel so that electrolyte is deflected by said one or more surfaces towards the ion-permeable wall and entrains particles of the particulate electrode as it moves thereby causing substantially all of the particles to circulate within the vessel constituting the cathode compartment. The circulation effected is preferably such that there exist two regions within the cathode compartment, the first region being adjacent to the ion-permeable wall and having a relatively low average number of particles per unit volume such that substantially all of the particles in the first region are separated from each other for a major part of the time during which they are present in the first region; and the second region being spaced apart from the ion-permeable wall and having a relatively high average number of particles per unit volume such that substantially all of the particles in the second region are in contact with other particles for a major part of the time during which they are present in the second region.

For a better understanding of the invention, and to show more clearly how the same may be carried into effect, reference will now be made, by way of example, to the accompanying drawings, in which FIGS. 1 to 5 show respective vertical sections through the lower parts of five embodiments of electrochemical cell of the invention.

FIG. 1 shows the lower part of an electrochemical cell 1 which is generally rectangular in cross-section and which includes an electrode system comprising a vessel 3 with a back wall 6 and a separator 5 including an ion-permeable diaphragm 4 constituting an ion-permeable wall; a current feeder 8; a plurality of electroconductive particles (not shown); and means for flowing an electrolyte through the vessel. The means for flowing electrolyte includes a flow distributor comprising a distributor block 14 and tapered members 22 and 23 located above and abutting the block 14. A plurality of parallel channels 12, 12' whose longitudinal axes at the point where they discharge into the vessel are perpendicular to the plane of the ion-permeable diaphragm 4 are formed in the block 14 and the member 22. A baffle plate 16 having holes 18 is fitted beneath the distributor block 14. The baffle plate 16 acts as a predistributor located within an expansion chamber 15, 17. A conduit 20 is provided for supplying electrolyte to the expansion chamber and thence to the flow distributor. The presence of the tapered members 22 and 23 results in the formation of a downwardly and inwardly tapering portion of the vessel adjacent the distributor block 14. The tapered member 22, in addition to being part of the flow distributor, constitutes an ion-impermeable portion of the separator. The electrochemical cell further comprises a counter electrode 24 disposed on the opposite side of the separator from the electrode system and contained within an electrode compartment 26. In some embodiments, the counter electrode may be used to support the ion-permeable diaphragm 4.

The space within the vessel 3, which in use acts as a cathode compartment, has a thickness between the back wall 6 and the ion-permeable diaphragm 4 of 44 mm while the corresponding dimension in the anode compartment 26 is 20 mm. The total width and height of the cell are each about 500 mm. The inlet conduit 20 is 1 inch in diameter and the baffle plate has 16 evenly spaced 5 mm diameter holes. The channels 12, 12' of the flow distributor are disposed in line at intervals of 51 mm across the width of the cell. The tapered member 22 has a maximum thickness of 19 mm and a height of 115 mm. The tapered member 23 has a height and a thickness of 15 mm.

During operation of the electrochemical cell, electrolyte is passed to a steady rate into the expansion chamber 15, 17 and thence via the channels 12,12' into the cathode compartment 26. The channels 12' direct the electrolyte onto the surface of the tapered member 23, which deflects the electrolyte flow generally upwardly and towards the ion-permeable wall 4. The particles of the particulate electrode are caused to circulate with the electrolyte. The rate of flow of electrolyte is sufficient to generate the circulating flow of particles described above. The surface of the tapered member 22 acts as a guide for the electrolyte flow, and provides a solid surface on which particles of the particulate electrode may impinge, thereby lessening the tendency of the particles to abrade the ion permeable wall. The flow of electrolyte and particles upwardly along the surface of tapered member 22 also tends to prevent the downward movement of particles adjacent to the ion permeable wall. Tapered member 22 may also assist in screening the electroactive area within the cell from the entry region of the electrolyte. Depending on the nature of the diaphragm 4, electrolyte may or may not pass through the separator. However, in order that current should flow between the electrodes of the cell it is necessary for the electrical charge to pass through the separator.

A potential difference is applied across the current feeder 8 and counter electrode 24. The electrically conductive particles move around the vessel in response to the flow of electrolyte through the channels 12, 12' and participate in the electrochemical process, reaction occurring at their surfaces. The manner in which the particles are believed to circulate around the vessel is shown schematically by the arrows *f*.

Figure 2:
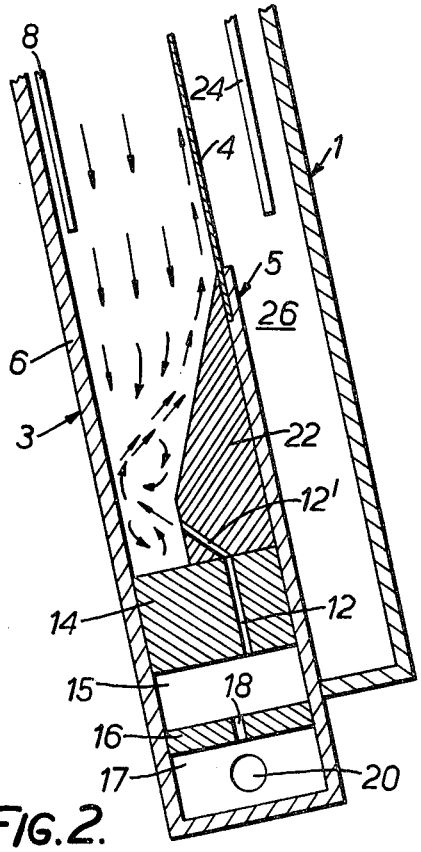

The embodiment of FIG. 2 is generally similar in construction and operation to that shown in FIG. 1. It differs in that the cell does not have a tapered member 23 and that the channels 12' discharge into the vessel at an angle of 45° to the plane of the ion-permeable diaphragm 4.

Figure 3:
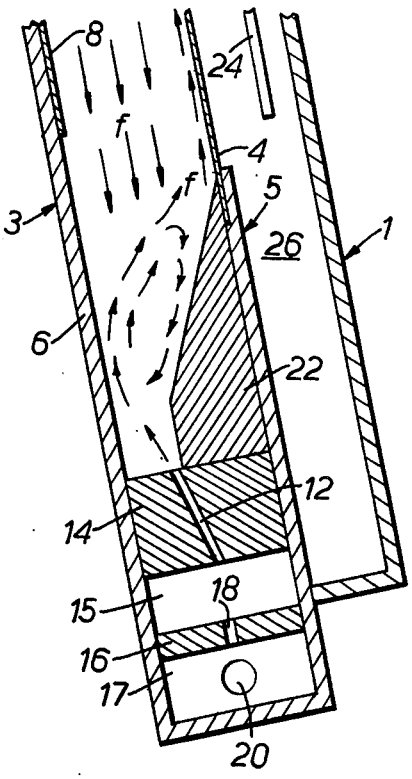
Figure 4:
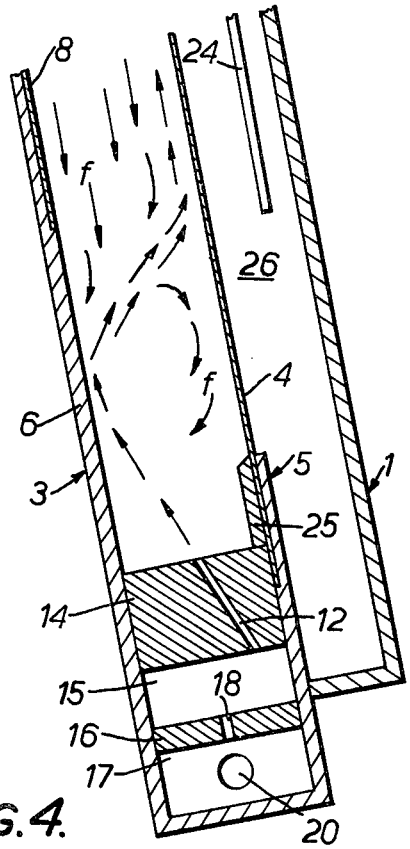

The embodiments of FIGS. 3 and 4 are generally similar to that of FIG. 2. In FIG. 3, channels 12 issue from the distributor block 14 directly into the vessel. The tapered member 22 thus has no channels 12'. The channels 12 are disposed at an angle of approximately 7° to the plane of the ion-permeable diaphragm 4. In FIG. 4, the tapered member 22 has been replaced by a much smaller plate 25 which is believed to have little effect on the flow patterns within the vessel but constitutes an ion-impermeable portion of the separator immediately above the distributor block 14. The channels 12 are disposed at an angle of 14° to the plane of the ion-permeable diaphragm 4, the latter having a greater downwards extent in this embodiment.

Figure 5:
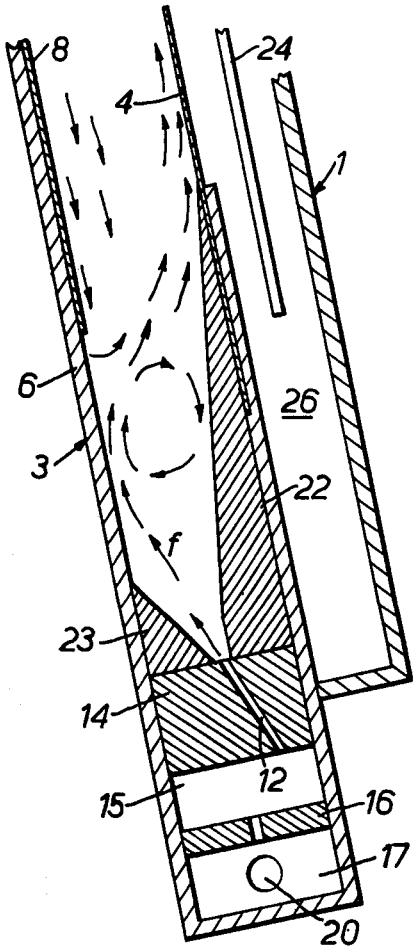

In FIG. 5, the general arrangement is similar to that shown in FIG. 1, except that the channels 11 debouch directly into the interior of the vessel 3 without passing through the tapered member 22. The cell width (normal to the plane of the paper) is 500 mm, and the distance between the back wall 6 and the ion-permeable membrane 4 is 35 mm. Tapered member 22, which is ion-impermeable, is 100 mm high and 16 mm deep at its base. Tapered member 23 is 20 mm high and 12 mm deep at its base. There are 14 channels 12 arranged in line, each channel having a diameter of 2.5 mm and the spacing between adjacent channels being 37 mm. Each channel makes an angle of 25° with the plane containing the ion-permeable membrane. Good results have been achieved using this cell with a particulate electrode consisting of copper particles from 350 to 1600 microns in diameter, the electrochemical cell being tilted at an angle of approximately 16° from the vertical, and the electrolyte flow rate through the channels 12 being from 1.96 to 2.10 cubic meters per hour.

What is claimed is:

1. An electrode system comprising a vessel bounded by a first wall including an ion-permeable portion and by a second wall opposite said first wall; a current feeder within said vessel spaced apart from said ion-permeable portion; and a plurality of electrically conductive particles free to move within a region between the current feeder and the ion-permeable portion and constituting, in use, a particulate electrode, said vessel incorporating at the base thereof a flow distributor means for discharging fluid into said vessel which comprises at least one channel debouching into the interior of the vessel, the end portion of each channel remote from the base of the cell being an outlet which is directed so as to discharge said fluid directly into said vessel from said outlet in a direction initially generally away from said ion-permeable portion and towards said second wall and in a direction so as to cause subsequent deflection of said fluid by said second wall or by a member attached to said second wall towards said ion-permeable portion and then upwardly in a direction substantially parallel to said ion-permeable portion.

2. An electrode system as claimed in claim 1, wherein there are a plurality of substantially parallel channels in said flow distributor.

3. An electrode system as claimed in claim 2, wherein the outlets of the channels are arranged in line or in a series of parallel lines.

4. An electrode system as claimed in claim 3 wherein said ion-permeable portion is planar.

5. An electrode system as claimed in claim 1, wherein the current feeder is recessed into said second wall.

6. An electrode system as claimed in claim 1, wherein those portions of the vessel adjacent to the outlets of the channel or channels of the flow distributor are downwardly and inwardly tapered.

7. An electrode system as claimed in claim 1, wherein there is provided within the vessel a tapered member extending downwardly and inwardly from said first wall towards the base of the vessel.

8. An electrode system as claimed in claim 7, wherein the channel or channels in the flow distributor extend into, and debouch into the interior of the vessel from, said tapered member.

9. An electrode system as claimed in claim 8, wherein the channel or channels discharge a fluid, in use, onto a second tapered member secured to said second wall.

10. An electrode system as claimed in claim 1, wherein the axis of said end portion of the channels or each channel is at an angle of from about 7° to about 90° with respect to the plane of the ion-permeable wall.

11. An electrode system as claimed in claim 10, wherein said axis is at an angle of from about 20° to about 30° with respect to the plane of the ion-permeable wall.

12. An electrode system as claimed in claim 1, wherein the flow distributor is fed by means of an expansion chamber.

13. An electrode system as claimed in claim 12, wherein said expansion chamber contains, or is supplied from, a predistributor.

14. An electrode system as claimed in claim 1, wherein the particulate electrode consists of metallic spheroids.

15. An electrode system as claimed in claim 14, wherein the particulate electrode consists of copper, nickel or cobalt.

16. An electrode system as claimed in claim 15, wherein the particulate electrode consists of particles from 100 to 3000 microns in size.

17. An electrode system comprising a generally rectangular-section vessel having a back wall bounding on side of the vessel, a support wall bounding the side of the vessel opposite said one side and including an ion-permeable wall portion; a current feeder within said vessel spaced apart from said ion-permeable wall portion; and a plurality of electrically conductive particles free to move within a region between the current feeder and the ion-permeable wall portion and constituting, in use, a particulate electrode, said vessel incorporating at the base thereof a flow distributor which comprises a plurality of channels discharging directly into the interior of the vessel, the channels being arranged with their outlets in line at or near the vertex of a downwardly and inwardly tapering region of the vessel and being directed so that, when said electrode system is in use, a fluid discharged into said vessel through said flow distributor debouches initially directly into said vessel from said outlets in a direction away from the ion-permeable wall portion generally towards said back wall of the vessel and is then deflected towards the ion-permeable wall portion and then upwardly in a direction substantially parallel to said ion-permeable wall.

18. An electrode system as claimed in claim 17, wherein the axis of the channels is the region of the outlet thereof is at an angle of from about 7° to about 90° with respect to the plane of the ion-permeable wall portion.

19. An electrode system as claimed in claim 18, wherein said axis is at an angle of from about 20° to about 30° with respect to the plane of the ion-permeable wall portion.

20. An electrode system as claimed in claim 17, wherein the flow distributor is fed by means of an expansion chamber which contains, or is supplied from, a predistributor.

21. An electrode system as claimed in claim 17, wherein the particulate electrode consists of metallic spheroids.

22. An electrode system as claimed in claim 21, wherein the particulate electrode consists of copper, nickel or cobalt.

23. An electrode system as claimed in claim 22, wherein the particulate electrode consists of particles from 100 to 3000 microns in size.

24. An electrochemical cell comprising an electrode system as claimed in claim 17, and an electrode compartment containing a counter electrode adjoining the electrode system contiguous with the support wall and remote from said current feeder.

25. A cell as claimed in claim 24, wherein said counter electrode is non-particulate.

26. A cell as claimed in claim 25, wherein said counter electrode supports at least part of the ion-permeable wall portion.

* * * * *